US009589703B2

(12) United States Patent
Siripurapu et al.

(10) Patent No.: US 9,589,703 B2
(45) Date of Patent: Mar. 7, 2017

(54) DATA CABLES HAVING AN INTUMESCENT TAPE

(71) Applicant: GENERAL CABLE TECHNOLOGIES CORPORATION, Highland Heights, KY (US)

(72) Inventors: Srinivas Siripurapu, Carmel, IN (US); Scott M. Brown, Independence, KY (US); Sean W. Culligan, Zionsville, IN (US); Stephen A. Thwaites, Walton, KY (US); Jianmin Liu, Carmel, IN (US); Eric W. Bates, Lafayette, IN (US); Roy Kusuma, Sharon, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 14/538,084

(22) Filed: Nov. 11, 2014

(65) Prior Publication Data

US 2015/0129277 A1 May 14, 2015

Related U.S. Application Data

(60) Provisional application No. 61/902,488, filed on Nov. 11, 2013.

(51) Int. Cl.
*H01B 7/295* (2006.01)
*H01B 3/30* (2006.01)
(Continued)

(52) U.S. Cl.
CPC ..... *H01B 7/295* (2013.01); *H01B 3/30* (2013.01); *H01B 3/441* (2013.01); *H01B 7/02* (2013.01); *H01B 11/02* (2013.01)

(58) Field of Classification Search
CPC ..... H01B 7/295; H01B 7/02; H01B 11/02; H01B 3/30
(Continued)

(56) References Cited

U.S. PATENT DOCUMENTS 3,917,892 A 11/1975 Kawaguchi et al.
4,543,368 A 9/1985 Smearing et al.
(Continued)

FOREIGN PATENT DOCUMENTS

CN 1905087 A 1/2007
EP 1211540 A1 6/2002
(Continued)

OTHER PUBLICATIONS

Thomas, Shane; International Search Report and Written Opinion of the International Searching Authority, issued in International Application No. PCT/US2014/064981; dated as mailed on Feb. 4, 2015; 13 pages.
(Continued)

*Primary Examiner* — Hoa C Nguyen
*Assistant Examiner* — Amol Patel
(74) *Attorney, Agent, or Firm* — Ulmer & Berne LLP

(57) ABSTRACT

A data cable can include a plurality of insulated conductors twisted into pairs, an intumescent tape surrounding one or more of the insulated conductors, and a jacket. Each of the plurality of insulated conductors includes a conductor and an insulation layer. Data cables being fluoropolymer-free or halogen free are also described herein.

10 Claims, 3 Drawing Sheets

(51) Int. Cl.
*H01B 7/02* (2006.01)
*H01B 11/02* (2006.01)
*H01B 3/44* (2006.01)

(58) Field of Classification Search
USPC ..... 174/103, 121 A, 113 R
See application file for complete search history.

(56) References Cited

U.S. PATENT DOCUMENTS

| | | | | |
|---|---|---|---|---|
| 4,600,634 | A * | 7/1986 | Langer | B32B 5/02 162/159 |
| 4,605,818 | A | 8/1986 | Arroyo et al. | |
| 4,941,729 | A | 7/1990 | Hardin et al. | |
| 4,969,706 | A | 11/1990 | Hardin et al. | |
| 5,024,506 | A | 6/1991 | Hardin et al. | |
| 5,074,640 | A | 12/1991 | Hardin et al. | |
| 5,202,946 | A | 4/1993 | Hardin et al. | |
| 5,619,016 | A | 4/1997 | Newmoyer | |
| RE37,010 | E | 1/2001 | Newmoyer | |
| 6,392,152 | B1 * | 5/2002 | Mottine, Jr. | H01B 3/441 174/110 PM |
| 6,818,832 | B2 | 11/2004 | Hopkinson et al. | |
| 7,271,343 | B2 | 9/2007 | Clark | |
| 7,696,437 | B2 | 4/2010 | Clark et al. | |
| 8,013,076 | B2 | 9/2011 | Haralur et al. | |
| 8,013,251 | B2 | 9/2011 | Bhandari et al. | |
| 8,309,637 | B2 | 11/2012 | Sanner et al. | |
| 2002/0098357 | A1 * | 7/2002 | Keogh | B32B 1/00 428/375 |
| 2007/0149629 | A1 * | 6/2007 | Donovan | C08J 9/0061 521/134 |
| 2009/0163609 | A1 | 6/2009 | Lassor et al. | |
| 2009/0163610 | A1 | 6/2009 | Lanning et al. | |
| 2011/0226508 | A1 | 9/2011 | Aoi et al. | |
| 2012/0285724 | A1 | 11/2012 | Oya et al. | |
| 2013/0037302 | A1 | 2/2013 | Kroushl et al. | |
| 2013/0115844 | A1 | 5/2013 | Kihara et al. | |
| 2014/0262427 | A1 | 9/2014 | Brown et al. | |

FOREIGN PATENT DOCUMENTS

| | | | |
|---|---|---|---|
| WO | 9427298 | A1 | 11/1994 |
| WO | 9712377 | A1 | 4/1997 |
| WO | 2004000941 | A1 | 12/2003 |

OTHER PUBLICATIONS

Wikipedia; Plenum cable; retrieved from https://en.wikipedia.org/w/index.php?title=Plenum_cable&oldid=576602857; revision as edited on Oct. 10, 2013; 2 pages.

* cited by examiner

DATA CABLES HAVING AN INTUMESCENT TAPE

REFERENCE TO RELATED APPLICATION

The present application claims priority of U.S. provisional application Ser. No. 61/902,488, entitled DATA CABLE, filed Nov. 11, 2013, and hereby incorporates the same application herein by reference in its entirety.

TECHNICAL FIELD

The present disclosure generally relates to fluoropolymer-free or halogen-free data communication cables.

BACKGROUND

Conventional data communications cables typically include several components, such as a jacket, one or more insulated wires, and cable separators. Conventional materials used in the construction of such components, however, often have poor smoke and/or flame-retardant properties. While it is known to add, or use, halogenated or fluorinated materials, such as polyvinylchloride ("PVC"), to meet industry burn and flame requirements, there are a number of drawbacks associated with such use. For example, when a halogenated, or fluorinated, cable catches fire, toxins, such as chlorine, are released. Additionally, such smoke suppressants and flame retardants increase the stiffness of the cable, as well as the dielectric constant and dissipative electrical properties. Accordingly, there is a need for halogen-free and fluoropolymer-free data communications cable which maintain the electrical and mechanical properties of conventional materials while also exhibiting excellent flame spread and emission characteristics.

SUMMARY

In accordance with one example, a halogen-free data cable includes a plurality of insulated conductors twisted into pairs, at least one intumescent tape surrounding at least one of the pairs of insulated conductors, and a jacket. Each of the plurality of insulated conductors includes a conductor and a first insulation layer. The first insulation layer includes a primary polymer. The jacket is produced from a first thermoplastic polymer having a glass transition temperature at about 160° C. or higher.

In accordance with another example, a fluoropolymer-free data cable includes a plurality of insulated conductors twisted into pairs, at least one intumescent tape surrounding at least one of the pairs of insulated conductors, and a jacket. Each of the plurality of insulated conductors includes a conductor and a first insulation layer.

In accordance with another example, a halogen-free data cable includes a plurality of insulated conductors twisted into pairs, at least one intumescent tape surrounding at least one of the pairs of insulated conductors, and a jacket. Each of the plurality of insulated conductors includes a conductor and a first insulation layer. The first insulation layer includes a primary polymer. The jacket is produced from a first thermoplastic polymer having a glass transition temperature at about 160° C. or higher. The halogen-free data cable passes the UL 910 Steiner Tunnel Test.

DETAILED DESCRIPTION

Figure 1A:
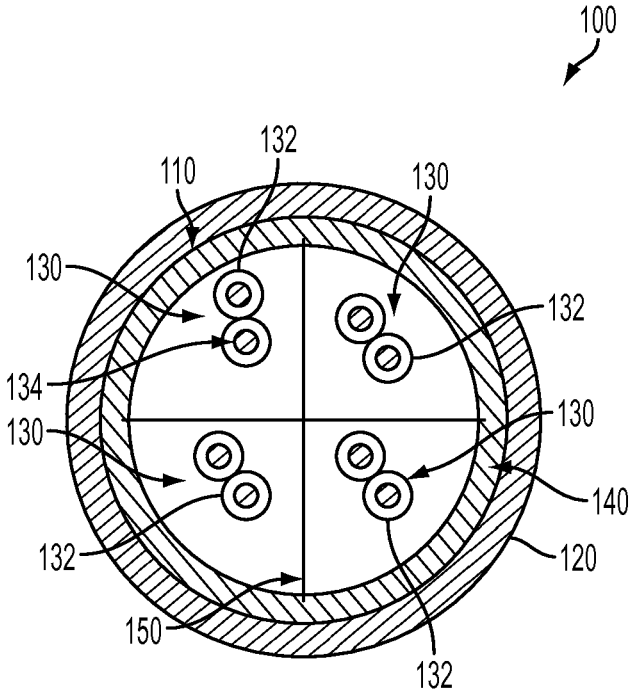
FIG. 1A depicts a cross-sectional view of a data cable including a cable separator, a plurality of insulated conductors, and an intumescent tape wrapped around the cable separator and the plurality of insulated conductors according to one embodiment.
Figure 1B:
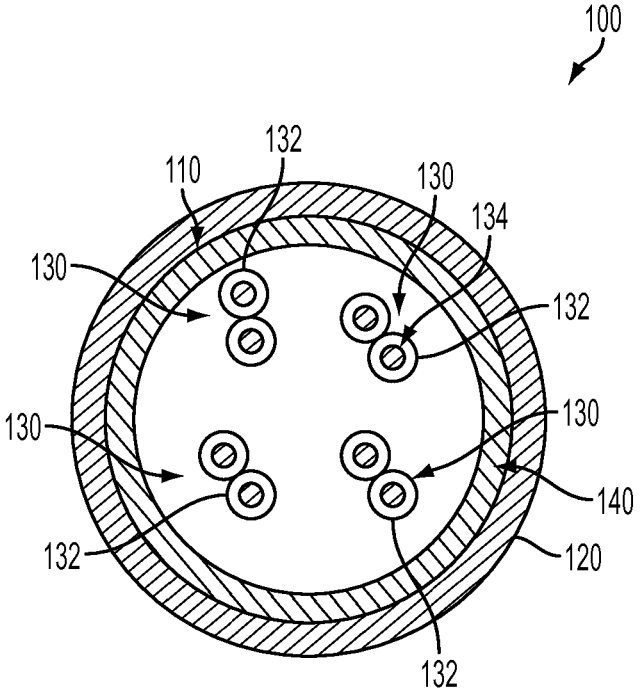
FIG. 1B depicts a cross-sectional view of a data cable including an intumescent tape wrapped around a plurality of insulated conductors according to one embodiment.

Referring to FIGS. 1A, 1B, 2A, 2B and 3, a data cable 100, 200 (or data communication cable) can include a core 110, 210, and a jacket 120, 220 surrounding the core 110, 220. The insulation materials of the core 110, 210 and the jacket 120, 220 can be fluoropolymer-free or halogen-free. The cable 100, 200 can pass the UL 910 Steiner Tunnel Test for use in plenum applications. In certain embodiments, the data cable 100, 200 can be fluoropolymer-free or halogen-free.

The cable core 110, 210 can include one, or more, transmission media. Examples of suitable transmission media can include copper conductors or optical fibers. For example, according to one embodiment, a transmission media can include a plurality of insulated pair of twisted conductors 130, 230, as depicted in FIGS. 1A, 1B, 2A and 2B.

Each insulated pair of twisted conductors 130, 230 can include an insulation layer 132 and a conductor 134. In one embodiment, one of the conductors 134, 234 in an insulated pair of twisted conductors 130, 230, can have an insulation layer 132 that is fluoropolymer-free. In certain embodiments, the insulation layer 132 can also be formed from a low-smoke and/or a halogen-free fire resistant polymer. Suitable halogen-free thermoplastic polymers can be selected from one, or more of, polyethersulfone, poly(arylether sulfone), poly(biphenylether sulfone), polysulfone ("PSU"), polyetherimide ("PEI"), polyetherimide ether, polyphenylene, polyimide, polyphenylsulfone ("PPSU"), polyphenylenesulfide, poly(aryletherketone), poly(etheretherketone), blends and copolymers thereof, and copolymers of the above resins with other polymers, such as polyolefins, silicone, and/or siloxanes. Examples of suitable polyolefins can include polyethylene, polypropylene, very-low density, maleated polypropylene, polybutylene, polyhexalene, polyoctene, ethylene-vinyl-acetate ("EVA") copolymer, chlorinated polyethylenes ("CPE"), ethylene-propylene-diene terpolymer ("EPDM"), polyetherimide-silicone copolymer, a polyetherimide-silicone copolymer and poly(etheretherketone) blend, a polyphenylene ether modified with elastomer, copolymers thereof, as well as mixtures, and blends thereof. As can be appreciated, suitable polyethylene polymers can include low-density polyethylene ("LDPE"), high-density polyethylene ("HDPE"), high molecular weight polyethylene ("HMWPE"), ultra-high molecular weight polyethylene ("UHMWPE"), and linear-low-density polyethylene ("LLDPE"). Alternatively, or in addition, the insulation layer 132 can be formed of one, or more, halogen-free polyolefins. As can be appreciated, such halogen-free polyolefins can, in certain embodiments, also be halogen-free fire-resistant polyolefins. According to certain embodiments, the insulation layer 132 can be solid or foamed.

Fluoropolymer-free can mean material that is substantially devoid of any fluoropolymer, such as, for example, free of fluorinated ethylene propylene copolymer ("FEP"), perfluoroalkoxy (methyl vinyl ether) ("MFA"), ethylene chlorotrifluoroethylene ("ECTFE"), polyvinylidene fluoride ("PVDF"), pertetrafluoroethylene ("PTFE"), and polychlorotrifluoroethylene ("PCTFE"). Halogen-free can mean material that is non-halogenated and/or that the total parts-per-million ("ppm") of trace halogens are at, or below, certain industry standards for halogen-free materials. For example, International Electrotechnical Commission ("IEC") 60754-2 and International Cable Engineers Association ("ICEA") S-90-661 both describe halogen-free materials as containing less than about 900 ppm chlorine or bromine, and less than about 1500 ppm total halogens. Halogen compounds are compounds that contain group 17 elements of the periodic table such as chlorine, fluorine, and bromine.

Figure 4:
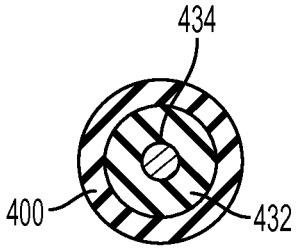
FIG. 4 depicts a cross-sectional view of an insulated conductor having two layers of insulation in accordance with one embodiment.

In certain embodiments, certain transmission media, such as, for example, a conductor 434 with an insulation layer 432, can include a second insulation layer 400 as depicted in FIG. 4. The second insulation layer 400 can have a glass transition temperature of about 160° C., or higher, and can be formed of halogen-free materials, such as PEI, PPSU and the like. As can be appreciated, any of the halogen-free thermoplastic polymers suitable for inclusion in the insulation layer 132 can also be suitable for the second insulation 400. The second insulation layer 400 can be added over insulation layer 432.

According to certain embodiments, the jacket 120, 220 as illustrated in FIGS. 1A, 1B, 2A, and 2B can be formed of any suitable halogen-free thermoplastic polymer that has a glass transition temperature at about 160° C. or higher. As can be appreciated, any of the halogen-free thermoplastic polymers useful for inclusion in the insulation layer 132 can be suitable for use in the jacket 120, 220. For example, a halogen-free thermoplastic polymer can be selected from one, or more of, polyethersulfone, poly(arylether sulfone), poly(biphenylether sulfone), polysulfone, polyetherimide ether, polyphenylene, polyimide, polyphenylsulfone, polyphenylenesulfide, poly(aryletherketone), poly(etheretherketone), blends and copolymers thereof, and copolymers of the above resins with other polymers, such as polyolefins, silicone, and/or siloxanes. Examples of suitable polyolefins can include polyethylene, polypropylene, very-low density, maleated polypropylene, polybutylene, polyhexalene, polyoctene, ethylene-vinyl-acetate (EVA) copolymer, chlorinated polyethylenes ("CPE"), ethylene-propylene-diene terpolymer ("EPDM"), polyetherimide-silicone copolymer, a polyetherimide-silicone copolymer and poly(etheretherketone) blend, a polyphenylene ether modified with elastomer, copolymers thereof, as well as mixtures, and blends thereof. As can be appreciated, suitable polyethylene polymers can include low-density polyethylene ("LDPE"), high-density polyethylene ("HDPE"), high molecular weight polyethylene ("HMWPE"), ultra-high molecular weight polyethylene ("UHMWPE"), and linear-low-density polyethylene ("LLDPE").

As will be appreciated, the insulation layer 132 and the jacket 120, 220 can be formed of the same material(s) or can be formed of different material(s) in certain embodiments.

A jacket can assist a cable to maintain optimal electrical and mechanical properties. For example, the jacket 120, 220 can help the cable 100, 220 maintain such electrical properties as an optimal dielectric constant and dissipation factors as well as mechanical properties such as flexibility, tensile strength, elongation, cold bend and cold impact properties. Additionally, the jacket 120, 220 can help the cable 100, 200 meet industry smoke and flame retardancy characteristics such as, for example, UL 910 standard for plenum applications.

Plenum can be defined as any space between a suspended ceiling and the base of the next higher floor above in a building. Plenum can also include ducts used to transport air. UL 910 sets forth the flame spread (i.e., flame propagation distance) and smoke producing (i.e., optical smoke density) requirements of plenum cable. Under the UL 910 requirements, the flame spread and smoke producing characteristics of a cable are measured by igniting 24 foot lengths of the cable using a 88 kW (300,000 BTU/hr) methane flame. The flame spread is aided by a 240 ft/minute draft. During a 20 minute test, the flame spread of the cable lengths is observed and smoke is measured by a photocell installed in an exhaust duct. To meet the UL 910 standard, a cable must have a flame spread of less than 5 feet beyond the end of the 4.5 foot ignition flame, a peak optical density of 0.5 (33% light transmission) and a maximum average optical density of 0.15 (70% light transmission).

According to certain embodiments, a binder or tape 140, 240 can be wrapped around one, or more, of the insulated pairs of twisted conductors 130, 230 as shown in the various embodiments illustrated in FIGS. 1A, 1B, 2A and 2B. According to certain embodiments, the tape 140, 240 can be an intumescent tape. Such intumescent tapes can be fire resistant.

As can be appreciated, intumescent flame retardant materials can foam upon exposure to flame and can allow for the protection of combustible materials such as plastics or wood against heat and fire exposure. Additionally, intumescent materials can help metals, such as steel, maintain their strength when exposed to high temperatures. Suitable intumescent flame retardants can generally include one, or more, "carbon" donors, one, or more, acid donors, and one, or more, spumific agents. For example, according to one embodiment, an intumescent flame retardant material can include a polyalcohol carbon donor such as one or more of starch or pentaerythritol. A non-limiting example of a suitable acid donor can include ammonium polyphosphate. According to certain embodiments, a suitable spumific compound for a intumescent flame retardant material can include melamine. Upon exposure to heat or flame, an intumescent flame retardant material can generally undergo the steps of: (1) softening of the binder/polymer; (2) release of an inorganic acid (e.g., ammonium polyphosphate); (3) carbonization (e.g., of polyalcohols); (4) formation of gas from the spumific compound (e.g., melamine); (5) foaming of the mixture; and (6) solidification of the flame retardant through cross-linking reactions.

Figure 3:
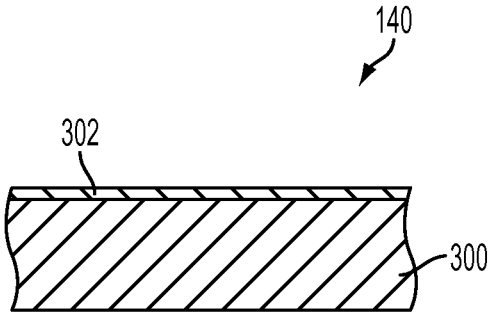
FIG. 3 depicts a cross-sectional view of an intumescent tape according to one embodiment.

As depicted in FIG. 3, in one embodiment, an intumescent tape can have a substrate layer 300 and an intumescent coating 302 on one side of the substrate layer 300. As can be appreciated however, the intumescent tape can also have an intumescent coating 302 on both sides of the substrate layer 300. The intumescent coating 302 can include a variety of flame retardant materials including, for example, nitrogen or phosphorus flame retardants, ammonium polyphosphate, melamine polyphosphate, metal phosphinates, ethylene diamine phosphate, a piperazine pyrophosphate blend, melamine cyanurate, expandable graphite, and blends and synergists thereof. The substrate layer 200 can be formed of inorganic material or can be formed of an organic-inorganic composite. As an illustrative example, an inorganic-organic composite can be formed of an organic matrix reinforced with inorganic compounds, such as inorganic fillers and/or fibers. According to certain embodiments, the organic matrix can be a thermosetting matrix formed from materials including epoxy, polyurethane, silicone, polyester, vinyl ester, and phenolic. Alternatively, the organic matrix can be a thermoplastic matrix formed from such materials as polypropylene, acrylic latex, polyamide, polyphenylene sulfide, polyimide, polyetherimide, and polyether ether ketone. A non-limiting list of suitable reinforcing fibers for such composites can include fiberglass, carbon, aramid, Kevlar®, or combinations thereof. According to certain embodiments, the tape 140 can be entirely or partially foamed.

Figure 2A:
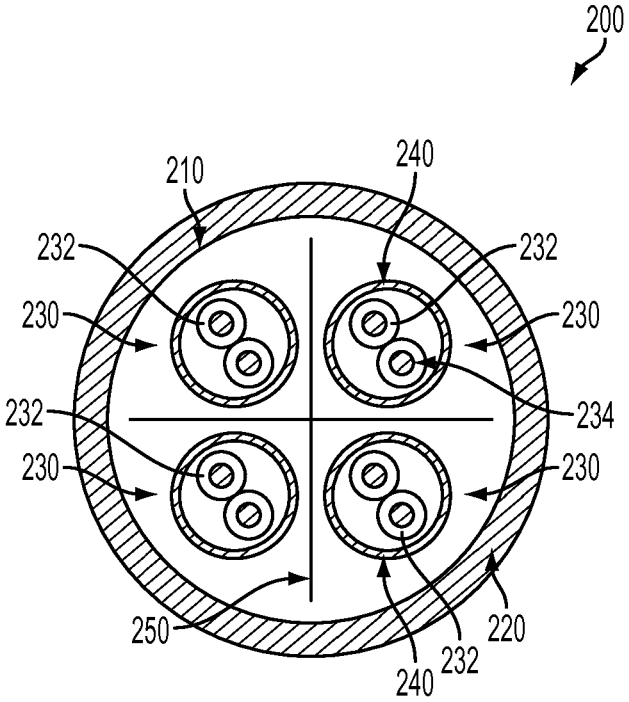
FIG. 2A depicts a cross-sectional view of a data cable including a cable separator, a plurality of insulated conductors, and a plurality of intumescent tapes wrapped around each of the plurality of insulated conductors according to one embodiment.
Figure 2B:
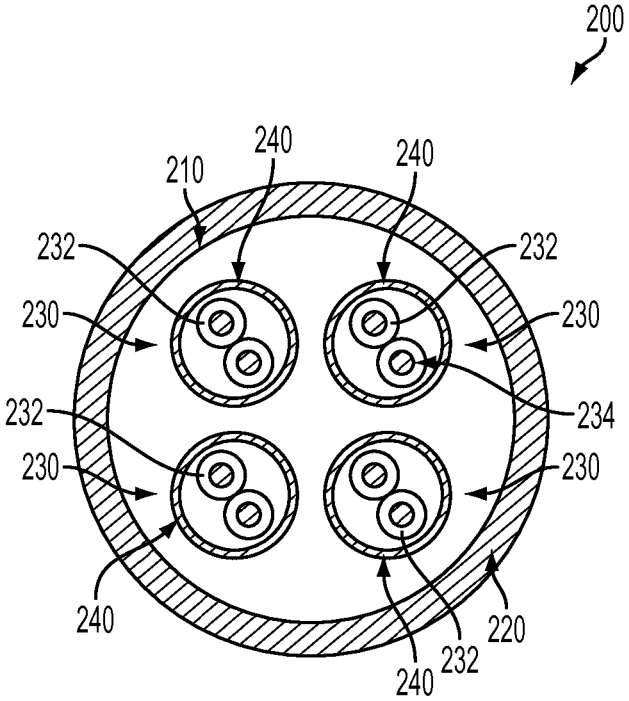
FIG. 2B depicts a cross-sectional view of a data cable including a plurality of insulated conductors and a plurality of intumescent tapes wrapped around each of the plurality of insulated conductors according to one embodiment.

According to certain embodiments, a cable 100, 200 can also include a separator 150, 250 in the cable core 110, 210 as shown in FIGS. 1A and 2A. The separator 150, 250 can isolate and separate certain transmission media such as, for example, each of the insulated pair of twisted conductors 130, as depicted in FIGS. 1A and 2A. The separator 150, 250 can be of any suitable shape, such as, for example, a crossweb. According to certain embodiments, the separator 150, 250 can be formed from a halogen-free thermoplastic polymer that has a glass transition temperature at about 160° C. or higher, such as, for example, any of the materials suitable for first insulation layer 132, second insulation layer 400 or jacket 120, 220 as described herein. Alternatively, or in addition to, the separator 150, 250 can be formed from materials described in U.S. Pre-Grant Publication No. 2014/0262427 titled "Foamed Polymer Separator For Cabling", filed Mar. 15, 2013, which is herein incorporated by reference. The separator 150, 250 can, according to certain embodiments, be entirely or partially foamed. As can be appreciated, halogen-free or fluoropolymer-free cables can also be used for other applications in addition to use as plenum cable. For example, in certain embodiments, fluoropolymer-free or halogen-free cables can be used as a riser cable and can pass the standards set forth in UL 1581 and/or UL 1666.

EXAMPLES

Table 1 below illustrates that cables which include an intumescent tape, but are free of fluoropolymers or halogenated compounds, can pass the UL 910 Steiner Tunnel Test. A passing result on the UL 910 Steiner Tunnel Test requires a flame spread of 5 feet or less. Specifically, Inventive Example 1 illustrates that a cable including a low-smoke, halogen-free, fire resistant conductor insulation, an intumescent tape, and a jacket formed of a blend of polyether imide siloxane copolymer and polyether ether ketone can pass the UL 910 Steiner Tunnel Test. The cable of Inventive Example 1 has a flame spread of 3.5 feet without the use of a fluoropolymer or halogenated compound. Comparative Examples 1 and 2 are comparative because each cable uses fluorinated ethylene propylene as conductor insulation. Comparative Examples 3 and 4 are comparative as they exhibit a flame spread of more than 5 feet.

TABLE 1

| Example | Conductor Insulation material | Tape | Jacket | Flame Spread |
|---|---|---|---|---|
| Comparative Example 1 | FEP | None | PVC | 2 ft |
| Comparative Example 2 | FEP | none | Blend of polyether imide siloxane copolymer and polyether ether ketone | 2.5 ft |
| Comparative Example 3 | FR polyolefin | none | PVC | 19.5 ft |
| Comparative Example 4 | FR polyolefin | Non-intumescent FR tape | Blend of polyether imide siloxane copolymer and polyether ether ketone | 9 ft |
| Inventive Example 1 | FR polyolefin | Intumescent FR tape | Blend of polyether imide siloxane copolymer and polyether ether ketone | 3.5 ft |

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A halogen-free data cable, comprising:

a plurality of insulated conductors twisted into pairs, each of the plurality of insulated conductors comprising a conductor and a first insulation layer, wherein the first insulation layer comprises a primary polymer;

at least one intumescent tape surrounding at least one of the pairs of insulated conductors, the intumescent tape comprising a substrate layer and an intumescent coating, wherein the substrate layer comprises an organic matrix and an inorganic compound, the inorganic compound comprising one or more of inorganic fillers and fibers; and the organic matrix comprises one or more of epoxy, polyester, polyurethane, silicone, vinyl ester and phenolic, polypropylene, polyamide, polyphenylene sulfide, polyimide, polyetherimide, and polyether ether ketone; and the one or more inorganic fillers and fibers are selected from the group consisting of fiberglass, carbon, aramid, Kevlar®, and combinations thereof; and a jacket.

2. The halogen-free data cable of claim 1, wherein the primary polymer comprises a polyolefin.

3. The halogen-free data cable of claim 2, wherein the polyolefin is a fire-resistant polyolefin.

4. The halogen-free data cable of claim 1, wherein the intumescent coating comprises one or more of nitrogen or phosphorus flame retardants, ammonium polyphosphate, melamine polyphosphate, metal phosphinates, ethylene diamine phosphate, a piperazine pyrophosphate blend, melamine cyanurate, expandable graphite, and synergists thereof.

5. The halogen-free data cable of claim 1, wherein the first insulation layer is substantially foamed or partially foamed.

6. The halogen-free data cable of claim 1, wherein the jacket is formed of a thermoplastic polymer having a glass transition temperature at about 160° C. or higher.

7. The halogen-free data cable of claim 6, wherein the thermoplastic polymer is selected from the group consisting of polyethersulfone, poly(arylether sulfone), poly(biphenylether sulfone), polysulfone, polyetherimide, polyphenylene ether, polyimide, polyphenylsulfone, polyphenylenesulfide, poly(aryletherketone), poly(etheretherketone), polyetherimide-silicone copolymer, polyphenylene ether modified with an elastomer, copolymers thereof, and combinations thereof.

8. The halogen-free data cable of claim 7, wherein the thermoplastic polymer forms copolymers with one or more polyolefins or siloxanes.

9. The halogen-free data cable of claim 1, wherein each of the conductors has a second insulation layer surrounding the first insulation layer; and each of the second insulation layers comprises a halogen-free thermoplastic polymer having a glass transition temperature at about 160° C. or higher.

10. The halogen-free data cable of claim 1, further comprising a separator that separates the plurality of insulated conductors twisted into pairs, and wherein the separator comprises a halogen-free thermoplastic polymer having a glass transition temperature at about 160° C. or higher.

* * * * *